US007843423B2

(12) United States Patent
Wang et al.

(10) Patent No.: US 7,843,423 B2
(45) Date of Patent: Nov. 30, 2010

(54) DRIVING DEVICE FOR DRIVING A LIGHT EMITTING UNIT

(75) Inventors: Chun-Chuan Wang, Taipei (TW); Chun-Ta Chen, Hsinchu County (TW)

(73) Assignees: AMIC Technology Corporation, Science-Based Industrial Park, Hsin-Chu (TW); Power Up, Inc., Jhubei, Hsin-chu County (TW)

( * ) Notice: Subject to any disclaimer, the term of this patent is extended or adjusted under 35 U.S.C. 154(b) by 366 days.

(21) Appl. No.: 12/182,150

(22) Filed: Jul. 30, 2008

(65) Prior Publication Data

US 2009/0302767 A1 Dec. 10, 2009

(30) Foreign Application Priority Data

Jun. 5, 2008 (TW) ..... 97120928 A

(51) Int. Cl.
*G09G 3/36* (2006.01)

(52) U.S. Cl. ..... 345/102; 345/101; 345/82; 345/212; 345/211

(58) Field of Classification Search ..... 345/101, 345/102, 204, 211–214, 207, 208, 52, 48, 345/46, 44, 82, 99
See application file for complete search history.

(56) References Cited

U.S. PATENT DOCUMENTS

2006/0007212 A1 * 1/2006 Kimura et al. ..... 345/204

* cited by examiner

*Primary Examiner*—Tuyet Thi Vo
(74) *Attorney, Agent, or Firm*—Winston Hsu; Scott Margo

(57) ABSTRACT

A driving device for driving a light emitting unit includes a power supply for generating power according to a control signal, an active signal generator for generating an active signal sequence according to lighting features of the light emitting unit, a heat-dissipation signal generator for generating a heat-dissipation signal sequence, a multiplexer coupled to the active signal generator and the heat-dissipation signal generator for combining the active signal sequence and the heat-dissipation signal sequence, so as to generate a driving signal sequence, a burst signal generator for generating a burst signal according to the lighting features of the light emitting unit, and a logic unit coupled to the multiplexer, the burst signal generator and the power supply for timely outputting the driving signal sequence according to the burst signal, so as to generate the control signal.

12 Claims, 2 Drawing Sheets

DRIVING DEVICE FOR DRIVING A LIGHT EMITTING UNIT

BACKGROUND OF THE INVENTION

1. Field of the Invention

The present invention relates to a driving device for driving a light emitting unit, and more particularly, to a driving device capable of effectively dissipating heat, improving light degradation of the light emitting unit and further extending the effective life of the light emitting unit.

2. Description of the Prior Art

Recently, application fields of light emitting diodes are widely developed. Different from an incandescent lamp, a light emitting diode emits luminescence light, and has advantages of low power consumption, long life, short warming time and rapid response. Moreover, since the light emitting diode is small, shake-proof, easily produced and can be manufactured into a tiny or arrayed element in conformation with different requirements, the light emitting diode is widely applied in an indicator light or a display device in information, communication and consumption electronic products. The light emitting diodes can be applied not only in outdoor monitors and traffic lights but also in any kinds of portable products, e.g. backlight of mobile phones or personal digital assistants, especially liquid crystal displays.

Though the light emitting diode has many advantages, there are some gaps from achieving illumination standards in application, which can be summarized in the following.

First, light degradation. The light degradation means that under the same driving power, luminance of the light emitting diode degrades as operating time increases, and the degradation is most obvious when the light emitting diode is initially activated. In other words, when turning on the light emitting diode at the first time, luminance degradation is most obvious. Therefore, although the light emitting diode has long life, the light degradation and deterioration of fluorescent powder and packaging materials can decrease the luminous flux under long-term operation. When the luminous flux decreases to a specific degree, the effective life of the light emitting diode is over, which cannot achieve requirements of illumination or backlight applications.

Second, heat of a light emitting diode chip. Though volume of the packaged light emitting diode is not small, surface area of the light emitting diode chip in some products is always less than 1 $mm^2$. In such a case, the current density under operation is so large that heat accumulates inside the diode dramatically. If heat cannot be dissipated, the chip is easily damaged. In addition, for achieving some illumination requirements, a lot of light emitting diodes are combined, causing dramatic temperature increase under long-term operation. To dissipate heat effectively, a lot of heat-dissipation areas need to be added, resulting in more difficulties in design of external structures.

SUMMARY OF THE INVENTION

It is therefore a primary objective of the claimed invention to provide a driving device for driving a light emitting unit.

The present invention discloses a driving device for driving a light emitting unit, which comprises a power supply, an active signal generator, a heat-dissipation signal generator, a multiplexer, a burst signal generator and a logic unit.

The power supply is utilized for generating power to the light emitting unit according to a control signal. The active signal generator is utilized for generating an active signal sequence according to lighting features of the light emitting unit, each active signal of the active signal sequence comprising a first cycle. The heat-dissipation signal generator is utilized for generating a heat-dissipation signal sequence, each heat-dissipation signal of the heat-dissipation signal sequence comprising a second cycle. The multiplexer is coupled to the active signal generator and the heat-dissipation signal generator for combining the active signal sequence and the heat-dissipation signal sequence, so as to generate a driving signal sequence, each driving signal of the driving signal sequence comprising a third cycle equal to a sum of the first cycle and the second cycle. The burst signal generator is utilized for generating a burst signal according to the lighting features of the light emitting unit, the burst signal comprising a forth cycle longer than the third cycle. The logic unit is coupled to the multiplexer, the burst signal generator and the power supply for timely outputting the driving signal sequence according to the burst signal, so as to generate the control signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
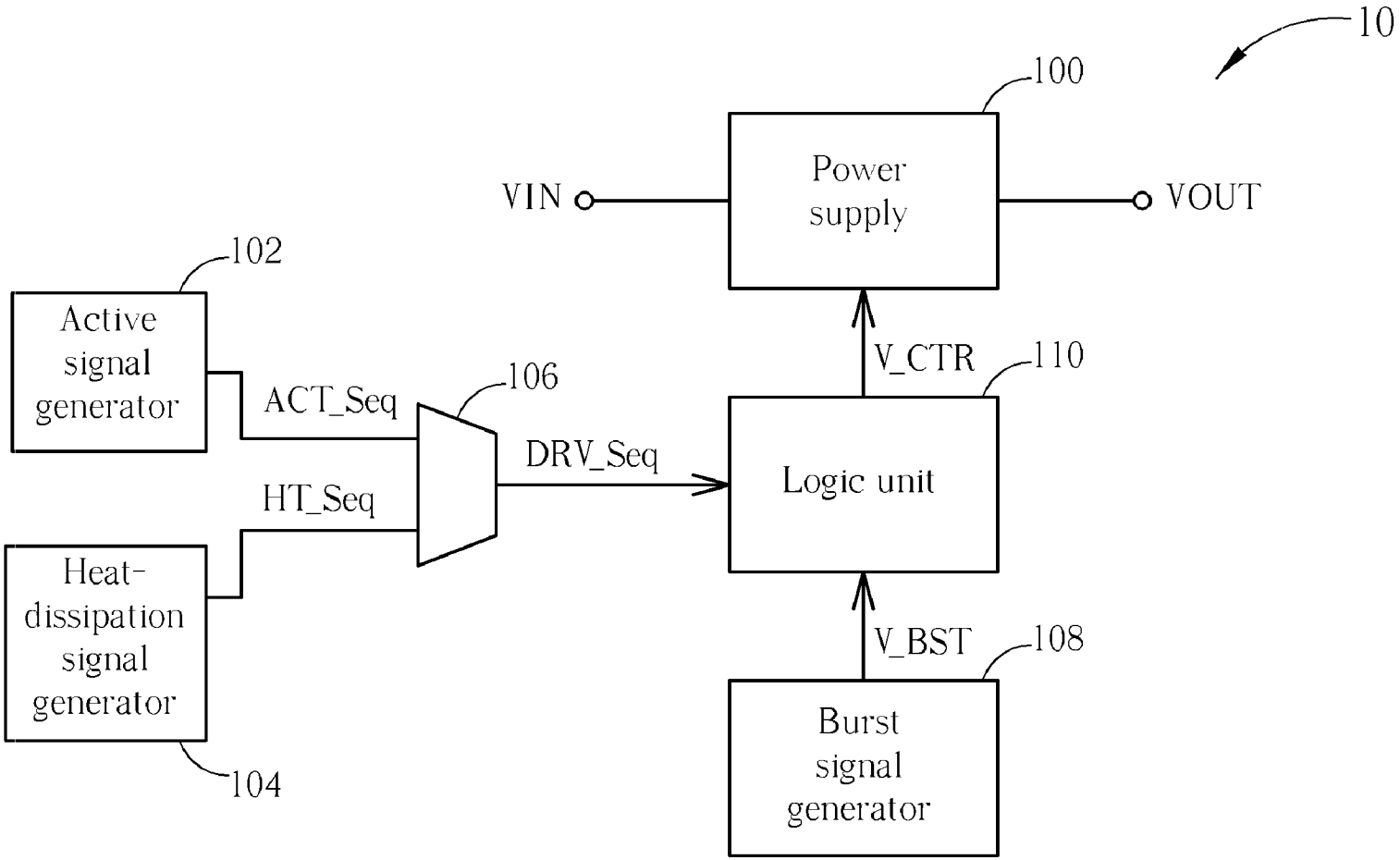
FIG. 1 is a schematic diagram of a driving device according to an embodiment of the present invention.

Please refer to FIG. 1. FIG. 1 is a schematic diagram of a driving device 10 according to an embodiment of the present invention. The driving device 10 is utilized for driving a light emitting unit, which is preferably a light emitting diode. The driving device 10 comprises a power supply 100, an active signal generator 102, a heat-dissipation signal generator 104, a multiplexer 106, a burst signal generator 108 and a logic unit 110. The power supply 100 is utilized for receiving an input voltage VIN and generating an output voltage VOUT to the light emitting unit. The active signal generator 102 is utilized for generating an active signal sequence ACT_Seq according to lighting features of the light emitting unit, so as to activate the power supply 100 to output power. The active signal sequence ACT_Seq includes a plurality of active signals ACT, and each has a cycle ACT_CCL. The heat-dissipation signal generator 104 is utilized for generating a heat-dissipation signal sequence HT_Seq to control the power supply 100 not to output power, such that the light emitting unit can dissipate heat. The heat-dissipation signal sequence HT_Seq includes a plurality of heat-dissipation signals HT, and each has a cycle HT_CCL. The multiplexer 106 is coupled to the active signal generator 102 and the heat-dissipation signal generator 104, and is utilized for combining the active signal sequence ACT_Seq and the heat-dissipation signal sequence HT_Seq, so as to generate a driving signal sequence DRV_Seq. The driving signal sequence DRV_Seq includes a plurality of driving signals DRV, and each includes an active signal ACT and a heat-dissipation signal HT. In other words, a cycle DRV_CCL of the driving signal DRV is equal to a sum of the cycle ACT_CCL and the cycle HT_CCL. The burst signal generator 108 is utilized for generating a burst signal V_BST according to the lighting features of the light emitting unit. The cycle BST_CCL of the burst signal V_BST is longer than the cycle DRV_CCL. The logic unit 110 is coupled to the multiplexer 106, the burst signal generator 108 and the power supply 100, and is utilized for timely outputting the driving signal sequence DRV_Seq according to the burst signal V_BST, so as to generate a control signal V_CTR to the power supply 100, thereby controlling magnitude and cycles of the power the power supply 100 outputted to the light emitting unit.

Figure 2:
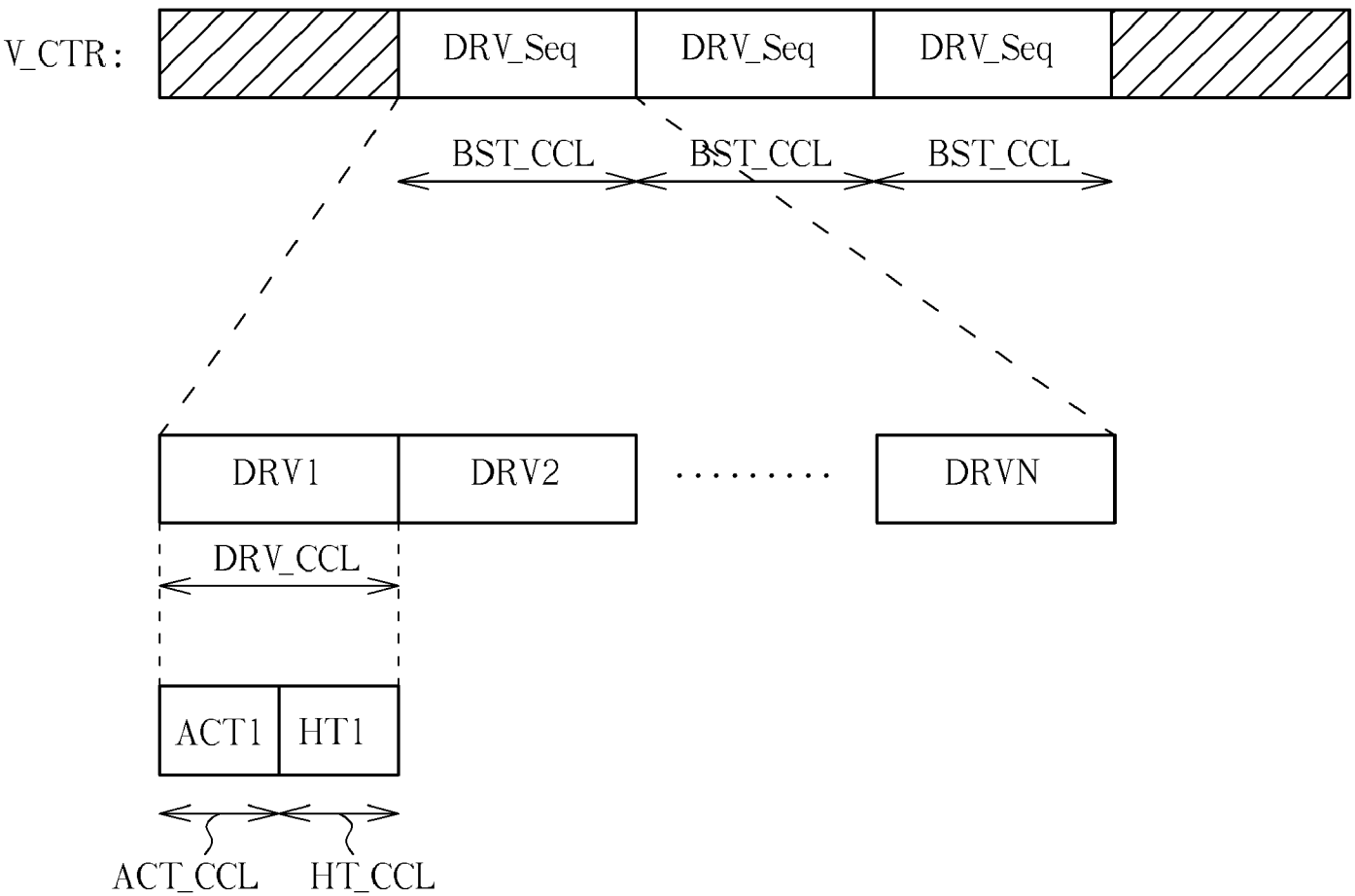
FIG. 2 is a schematic diagram of relations of the control signal, the driving signal sequence, the active signal and the heat-dissipation signal in FIG. 1.

As to detail operation of the driving device 10, please refer to FIG. 2, which is a schematic diagram of the control signal V_CTR, the driving signal sequence DRV_Seq, the active signal ACT and the heat-dissipation signal HT in FIG. 1. As shown in FIG. 2, the burst signal V_BST is utilized for controlling output of the driving signal sequence DRV_Seq. That is, during the cycle BST_CCL, the logic unit 110 can output the driving signal sequence DRV_Seq to the power supply 100, and outside the cycle BST_CCL, the logic unit 110 does not output signals or outputs a low level signal to the power supply 100. As a result, during the cycle BST_CCL, the power supply 100 can output proper power to the light emitting unit according to the level and cycle ACT_CCL of the active signal ACT of each driving signal DRV, and during the cycle HT_CCL of the heat-dissipation signal HT, the power supply 100 does not output power to the light emitting unit, so as to facilitate the light emitting unit to dissipate heat. Moreover, the present invention adjusts the cycles ACT_CCL, HT_CCL, BST_CCL and the level of the active signal ACT to achieve predetermined results according to the lighting features of the light emitting unit, e.g. luminance and chrominance. Certainly, the logic unit 110 can be alternatively designed not to output signals or output a low level signal to the power supply 100 during the cycle BST_CCL, and output the driving signal sequence DRV_Seq to the power supply 100 outside the cycle BST_CCL. In such a case, outside the cycle BST_CCL, the power supply 100 can output proper power to the light emitting unit according to the level and cycle ACT_CCL of the active signal ACT of each driving signal DRV, and during the cycle HT_CCL of the heat-dissipation signal HT, the power supply 100 does not output power to the light emitting unit, so as to facilitate the light emitting unit to dissipate heat.

As those skilled in the art recognized, a feature of human eyes is similar to a low pass filter. That is, human eyes are insensitive to rapid changes of luminance and chrominance. The present invention utilizes this feature to present the heat-dissipation signals HT and the active signals ACT alternately. When the active signal ACT is presented, the power supply 100 outputs driving power and the light emitting unit emits light. When the heat-dissipation signal HT is presented, the power supply 100 does not output driving power and the light emitting unit does not emit light, so as to dissipate heat. In such a case, since human eyes are insensitive to rapid changes of luminance and chrominance, the luminance and chrominance of light source outputted from the light emitting unit are unchanged and stable for human eyes. In other words, adding the heat-dissipation signals HT will not affect the luminance and chrominance of light source outputted from the light emitting unit. More important, via the heat-dissipation signals HT, the light emitting unit not only dissipates heat efficiently but also improves light degradation to further extend the effective life, because time of continuous operation of the light emitting unit is lessened.

Please note that, FIG. 1 and FIG. 2 are utilized for illustrating the present invention, and those skilled in the art can make alternations and modifications accordingly. For example, the power supply is not restricted to any categories of power supplies and can be a current-controlled power supply, e.g. boost, buck, boost-buck or buck-boost current-controlled power supply.

In conclusion, the present invention presents the heat-dissipation signals HT and the active signals ACT alternately in the driving signal sequence DRV_Seq, such that when the heat-dissipation signal HT is presented, the power supply 100 does not output driving power, so as to dissipate heat. Since human eyes are insensitive to rapid changes of luminance and chrominance, the present invention will not affect the luminance and chrominance of light source outputted from the light emitting unit. More important, via the heat-dissipation signals HT, the light emitting unit not only dissipates heat efficiently but also improves light degradation, to further extend the effective life of the light emitting unit, because time of continuous operation of the light emitting unit is lessened.

Those skilled in the art will readily observe that numerous modifications and alterations of the device and method may be made while retaining the teachings of the invention.

What is claimed is:

1. A driving device for driving a light emitting unit comprising:

a power supply for generating power to the light emitting unit according to a control signal;

an active signal generator for generating an active signal sequence according to lighting features of the light emitting unit, each active signal of the active signal sequence comprising a first cycle;

a heat-dissipation signal generator for generating a heat-dissipation signal sequence, each heat-dissipation signal of the heat-dissipation signal sequence comprising a second cycle;

a multiplexer coupled to the active signal generator and the heat-dissipation signal generator for combining the active signal sequence and the heat-dissipation signal sequence, so as to generate a driving signal sequence, each driving signal of the driving signal sequence comprising a third cycle equal to a sum of the first cycle and the second cycle;

a burst signal generator for generating a burst signal according to the lighting features of the light emitting unit, the burst signal comprising a forth cycle longer than the third cycle; and a logic unit coupled to the multiplexer, the burst signal generator and the power supply for timely outputting the driving signal sequence according to the burst signal, so as to generate the control signal.

2. The driving device of claim 1, wherein the lighting features of the light emitting unit are predetermined luminance of the light emitting unit.

3. The driving device of claim 1, wherein the lighting features of the light emitting unit are predetermined chrominance of the light emitting unit.

4. The driving device of claim 1, wherein the light emitting unit is a light emitting diode.

5. The driving device of claim 1, wherein the power supply is a current controlled power supply.

6. The driving device of claim 5, wherein the current controlled power supply is a boost current controlled power supply.

7. The driving device of claim 5, wherein the current controlled power supply is a buck current controlled power supply.

8. The driving device of claim 5, wherein the current controlled power supply is a boost-buck current controlled power supply.

9. The driving device of claim 5, wherein the current controlled power supply is a buck-boost current controlled power supply.

10. The driving device of claim 1, wherein the control signal is a combination of the driving signal sequence and a low level signal.

11. The driving device of claim 10, wherein the logic unit is utilized for outputting the driving signal sequence when the burst signal is in a first level, and outputting the low level signal to generate the control signal when the burst signal is in a second level.

12. The driving device of claim 10, wherein the power supply is utilized for outputting power to the light emitting unit during an active signal of the driving signal sequence, and not outputting power to the light emitting unit during a heat-dissipation signal of the driving signal sequence, according to the control signal.

* * * * *